United States Patent [19]

Axford et al.

[11] Patent Number: 4,680,591

[45] Date of Patent: Jul. 14, 1987

[54] HELICAL ANTENNA ARRAY WITH RESONANT CAVITY AND IMPEDANCE MATCHING MEANS

[75] Inventors: Walter J. Axford, Chalfont St. Peter; Francis R. Trumble, Maidenhead; Charles W. Turner, Virginia Water, all of England

[73] Assignee: EMI Limited, Hayes, England

[21] Appl. No.: 625,246

[22] Filed: Jun. 27, 1984

[30] Foreign Application Priority Data

Jul. 1, 1983 [GB] United Kingdom ..... 8317938

[51] Int. Cl.[4] ..... H01Q 1/36; H01Q 1/40

[52] U.S. Cl. ..... 343/853; 343/895

[58] Field of Search ..... 343/895, 789, 872, 873, 343/893, 844, 824, 846, 853, 860; 333/227, 230

[56] References Cited

U.S. PATENT DOCUMENTS

| | | | |
|---|---|---|---|
| 2,847,672 | 8/1958 | Giffin et al. | 343/895 |
| 2,863,148 | 12/1958 | Gammon et al. | 343/895 |
| 3,509,572 | 4/1970 | Barbano | 343/792.5 |
| 3,623,118 | 11/1971 | Monser | 343/863 |
| 4,197,545 | 4/1980 | Favaloro et al. | 343/700 MS |
| 4,322,731 | 3/1982 | Drabowitch | 343/895 |
| 4,356,497 | 10/1982 | Dudome | 343/895 |
| 4,400,703 | 8/1983 | Shiokawa et al. | 343/895 |

FOREIGN PATENT DOCUMENTS 1234751 6/1971 United Kingdom .

*Primary Examiner*—William L. Sikes
*Assistant Examiner*—Michael C. Wimer
*Attorney, Agent, or Firm*—Fleit, Jacobson, Cohn & Price

[57] ABSTRACT

An antenna is formed of four arrays each having sixteen helical antenna elements with probes located within a common resonant cavity. Thus cavity is used to combine all the outputs of elements.

The elements of array are arranged over the surface of box such that the probes are located at the voltage antinodes of the resonance field patterns in order to maximize the coupling efficiency. Likewise the output probe for each cavity 6 is also located at a voltage antinode; output probe enables the signal combined in cavity to pass into a waveguide, also connected to other arrays and, for passage to the television receiver.

5 Claims, 5 Drawing Figures

HELICAL ANTENNA ARRAY WITH RESONANT CAVITY AND IMPEDANCE MATCHING MEANS

FIELD OF THE INVENTION

The present invention relates to an antenna, and particularly but not solely to an antenna for the reception of Direct Broadcast Satellite (DBS) television signals.

DESCRIPTION OF RELATED ART

It is proposed that the DBS networks in Europe will operate on a carrier frequency of around 12 GHz. Flat plate antennas for this frequency range are made of an array of elements, each element being capable of receiving the 12 GHz signals. Due to the short (2.5 cm) wavelength involved the elements are small in size. To provide sufficient energy for satisfactory television pictures, a large array of elements is needed. For aesthetic reasons this aray should not be larger than about one square meter. The received signal from each of these elements has to be transmitted, in the correct phase relationship, to a common point so that the combined signal can be fed into the front end module of the receiver. However, in the transfer of these individual signals to the common collecting point, a substantial proportion of the signal can be lost.

OBJECT OF THE INVENTION

An object of the present invention is to provide a low-cost antenna having a high efficiency.

SUMMARY OF THE INVENTION

The present invention provides an antenna array comprising a plurality of helical antenna elements each of which is connected to a common resonant cavity thereby to combine in use the signals received by the helical elements.

Preferably, the array has means to effect electrical shorting at at least one location within the cavity. In one example the means to effect electrical shorting comprises one or more electrically conducting posts extending across the cavity and connected to a source of earthing.

The means to effect electrical shorting may be positioned within the cavity in order to separate the helical elements into two or more groups, whereby in use the outputs of the helical elements of a group are used to form a standing-wave mode or modes before combination with those from other groups.

Preferably, the helical elements are mounted on a common, electrically conducting plate of a thickness corresponding substantially to half the wavelength of the desired radiation.

In one form, the present invention provides an antenna comprising a plurality of antenna arrays as described above, whose outputs are electrically connected to effect summation of the received signals, at least some of the arrays each having a plurality of helical antenna elements connected to a resonant cavity common to the elements in that array, thereby to combine, within that cavity, the outputs of the helical elements in that array.

In one preferred form, antenna comprises a plurality of antenna arrays as described above, which share a single output, at least some of the arrays each having a plurality of helical antenna elements connected to a resonant cavity common to the elements in that array, thereby to combine, within the cavity, the outputs of the helical elements in that array.

In order that the invention may more readily be understood a description is now given, by way of example only, reference being made to the accompanying drawings, in which:

DESCRIPTION OF THE PREFERRED EMBODIMENT

Each of the illustrated antennas is designed to be particularly suited for receiving signals of the format intended for use by the Direct Broadcast Satellite (DBS) networks in Europe. Thus each antenna has elements of helical shape (particularly suited for receiving signals with circular polarization, a characteristic of the DBS signals) and can receive readily signals with frequencies in the region of 12 GHz (this being the approximate value of carrier frequencies to be used by the DBS networks). Each of the antennas is constructed in a flat-plate form, in order to maximise the surface area available for signal collection for a given volume used.

Figure 1:
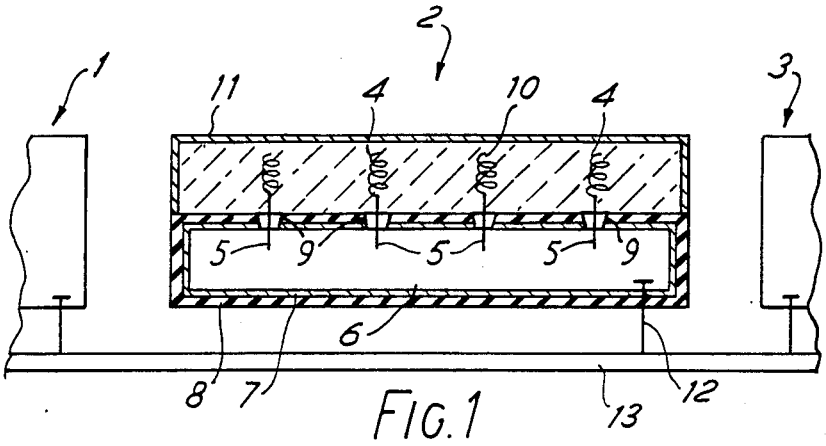
FIG. 1 is a cross-section of part of an antenna embodying the present invention.

Considering now the antenna partly shown in FIG. 1 it has a number of arrays (of which only 1, 2 and 3 are illustrated). Each array has sixteen helical antenna elements 4 each with eight turns in the helical section and a probe 5 at the opposite end, the probe 5 being located within a resonant cavity 6 common to all elements 4 in that array. In this way there is an electric coupling between all the elements 4 of the array 2 and the cavity 6 such that any electric field signal components received by elements 4 in array 2 are passed into cavity 6; thus the cavity 6 is used to combine all the outputs of elements 4. The resonant cavity 6 is defined by an electrically conducting lining 7 (e.g. aluminium alloy, copper, gold or silver) on the internal surface (measuring 126 mm by 126 mm by 10 mm) of a box 8 made from an insulating material.

In order to hold the elements 4 securely on the box 8, each element has, on a neck portion intermediate the helical section and the probe 5, a plug 9 of PTFE material which is force-fitted into a hole in the top surface of box 8. Although the plug 9 does grip the neck position of element 4 sufficiently strongly to prevent its movement during normal use, element 4 can still be slid in either direction relative to plug 9 to permit adjustment of the position of probe 5 in cavity 6. The helical portions of elements 4 of each array are embedded in expanded polystyrene 10 in order to provide support and to minimise the risk of damage. Expanded polystyrene 10 is a material of very low dielectric constant and low radio frequency loss so that its presence has an insignificant effect on the signal reception performance of the antenna. Expanded polystyrene 10 has an outer skin 11 of water-repellant plastics material to prevent water absorption.

The expanded polystyrene 10 and skin 11 may be replaced by any suitable material (or combination of materials) having similar characteristics of dielectric constant, radio frequency attenuation and water absorption.

The elements 4 of array 2 are arranged over the surface of box 8 such that the probes 5 are located at the voltage antinodes of the resonance field patterns in order to maximize the coupling efficiency. Likewise the output probe 12 for each cavity 6 is also located at a voltage antinode; output probe 12 enables the signal combined in cavity 6 to pass into a waveguide 13, also connected to other arrays 1 and 3, for passage to the television receiver.

Figure 2:
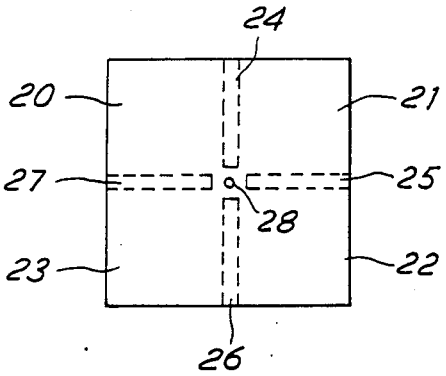
FIG. 2 is a plan view of the rear of another form of antenna.

The antenna shown in FIG. 2 consists of four arrays each generally similar to array 1 except that they are modified such as to form four resonant cavities 20, 21, 22 and 23 as a single unit having some walls 24, 25, 26 and 27 in common. Moreover all four cavities share a single output probe 28 located at an antinode for each cavity in the region of one of its corners. Thus this form of antenna does not require any waveguide interlinking the four cavities thereby reducing the possibility of signal loss and providing a compact design. Clearly there will still be a waveguide lining the output probe 28 to the television receiver (and possibly other units of four cavities if applicable).

In a modification, an antenna is formed of four arrays whose outputs are connected together by a waveguide, each array having sixteen helical antenna elements divided into four equal groups, each group feeding a resonant cavity; the four resonant cavities form a single unit having some walls in common, in similar fashion to that as shown in FIG. 2.

In each of the above antennas, the height of the resonant cavity is chosen such that the possibility of forming vertical standing waves is minimised.

In a modification to either of these antennas, loops can be used instead of probes 5, in which case the helical elements are arranged such that the loops are positioned at current antinodes of the resonant cavity 6.

The lined enclosures forming the resonant cavities of the antennas described above can be manufacuted cheaply and quickly, and are particularly suited to large-quantity production. As these enclosures replace the camparatively expensive microstrip transmission lines of conventional antennas, their use in antennas embodying the invention can result in a reduction in the overall cost of these antennas.

Figure 3:
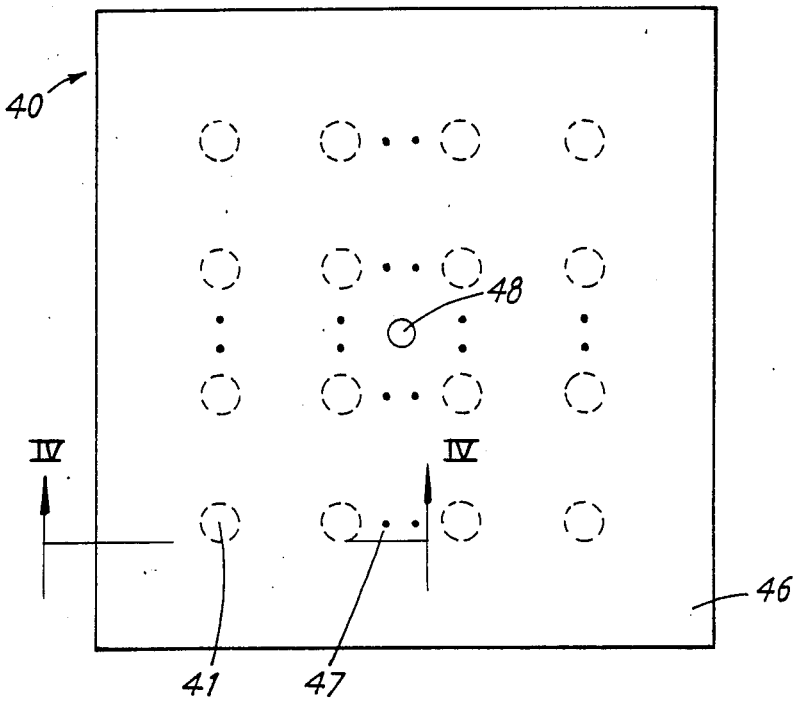
FIG. 3 is a schematic plan view of the rear of another form of array embodying the present invention.
Figure 4:
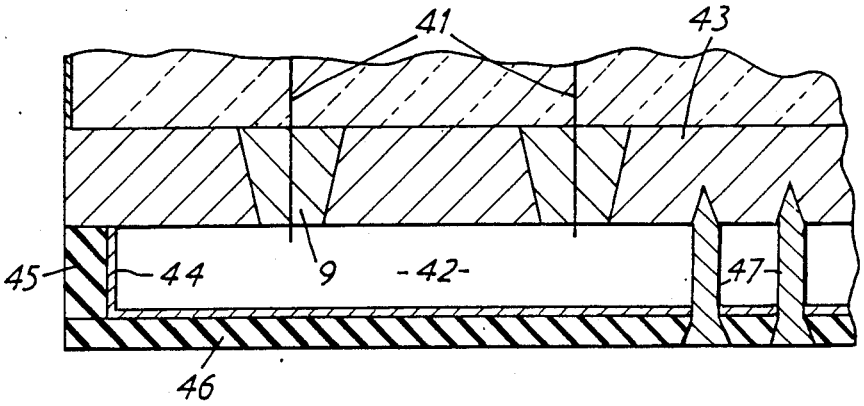
FIG. 4 is a partial cross-section of the array of FIG. 3.

FIG. 3 is a schematic plan view, from the rear, of another antenna array 40 embodying the present invention. FIG. 4 shows part of a cross-sectional view of array 40.

Array 40 has sixteen helical antenna elements 41 which are similar in construction to elements 4 and are likewise mounted within a resonant cavity 42. In this case, cavity 42 is defined by a metallic, electrically conductive plate 43 and by an electrically conducting lining 44 on sidewalls 45 and on a base 46, the sidewalls and base being of electrically insulating material.

It has been found that, by providing a plate 43 with a thickness corresponding approximately to one quarter the wavelength of microwaves, the gain and bandwidth performance of the antenna for that value of microwave radiation is significantly improved as compared to the form of array 2 shown in FIG. 1. Moreover, the gain and bandwidth performances can be further significantly improved by providing a plate 43 with a thickness corresponding to one half of the wavelength of microwave radiation intended to be picked up by the array; thus for example plate 43 may be 8 mm in thickness.

The thickness of plate 43 is used as a means of controlling the impendance presented to the cavity by the helix 4. The impendance of all the helices can be altered simultaneously by changing the thickness of the lid. The stem of the helix passing through the plate forms a length of coaxial line which can be used as an impedance transformer. Thus, by appropriate choice of the diameter of the plug and of the thickness of the electrically conducting surface (whether it be plate 43 as in FIG. 4 or lining 7 as in FIG. 1), particular impedance matching characteristics as desired can be selected from a wide range of possible values; in the forms of antenna described and illustrated herein, it was considered certain matching characteristics were particularly advantageous, but the present invention is clearly not limited to these specific values.

A number of shorting posts 47, which electrically contact both the plate 43 and lining 44, are located throughout the cavity 42 in an arrangement as shown in FIG. 3, in which the rings denote elements 41 and the dots denote shorting posts 47. In this way the resultant lines of post 47 effectively form barriers inhibiting the transference of electrical charges, so that for the purposes of the setting-up and progagation of standing-wave modes, the sixteen elements 41 are divided up into four groups each of four elements. Thus by appropriate choice of cavity dimensions, the output from cavity 42 can be designed such that the desired wavelength can be augmented while other wavelengths can be suppressed.

The shorting posts 47 placed at positions as shown in FIG. 3 effectively convert the cavity 42 to the form shown in FIG. 2 without requiring the use of solid walls.

Cavity 42 has an output probe 48 which connects with one arm of an H-shape waveguide which is also fed with the signals from three other arrays identical to array 40, the four arrays forming a single flat-plate antenna for the reception of DBS television signals. In one specific example, such an antenna is formed of four arrays each having a reception surface of 125 mm square, a resonance cavity height of 10 mm, a helical element spacing of 37.5 mm and an overall antenna depth of 70 mm; this antenna could produce a gain of 23 db for broaside incident radiation of 12 Gigaherz.

The provision of posts 47 also provides the aray 40 with an improved mechanical rigidity as compared to array 2.

In a modification to array 40, the posts 47 are arranged throughout the cavity 42 such that each element 41 has one or more adjacent posts 47 in order to suppress undesired modes of standing waves.

It has been found that an array formed of groups of four helical elements is more efficient in terms of gain per unit area than groups of other sizes (for example of nine helical elements).

Figure 5:
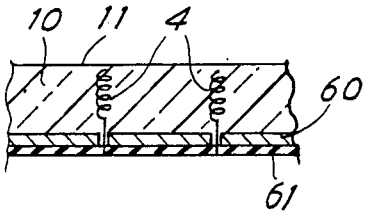
FIG. 5 is a cross-section of part of another antenna.

The antenna partly shown in FIG. 5 differs from that of Fig. 1 in that all the helical elements 4 in an array are mounted on a common printed circuit board 60, the stem of each element extends through a hole in the ground plane of pcb 60 and is soldered to the printed metal strip 61 on the opposite side in order to pass any received signals on to the television receiver with the correct phase relationships.

Any of the antennas may be modified such that there is a variation in the signal transmission efficiencies of the helical elements so as to provide a particular amplitude distribution over the area of the antenna. This variation may be achieved by, for example, having some elements with a different number of turns in the helical section or by adjusting the coupling between some elements and the cavity. Additionally or alternatively, there may be a variation in the orientation (relative to the longitudial axis) of some helical elements, in order to provide a phase distribution of signals received over the antenna surface. Furthermore, some or all of the helical elements may have their longitudinal axes inclined (rather than perpendicular to) the major axis of the antenna. The helical elements have preferably a common angle of inclination; alternatively there may be a plurality of different angles of inclination in a group of helical elements.

One or more of these modifications may be used to provide the antenna with a response beam tilted away from the direction normal to the major plane of the antenna. The antenna may have a response beam with constant tilt or one whose angle of tilt can be varied as required.

We claim:

1. An antenna array comprising:

a plurality of helical antenna elements, each having a straight stem end portion;

means to combine signals received at the respective helical antenna elements;

means to define a single resonant cavity, the single resonant cavity constituting signal-combining means;

a wall member defining a surface of the single resonant cavity, said wall member having a number of apertures which communicate with the single resonant cavity and said wall member providing support for the helical antenna elements;

each said helical antenna element being mounted over said wall member such that the straight stem extends through a respective aperture with the free end of the stem within the single resonant cavity, thereby to provide coupling between the elements and the cavity;

electrically-conductive material, of the wall member, forming the cavity-defining surface of that wall member;

means to control impedance between the helical antenna elements and the cavity;

the impedance-control means being constituted by a predetermined value of thickness of the electrically-conductive material of the wall member.

2. An antenna array according to claim 1, wherein the impedance-control means is contituted by an electrically-conducting lining deposited on a substrate of electrically insulating material which substrate defines said wall member.

3. An antenna array according to claim 1, wherein the impedance-control means is constituted by an electrically-conductive plate having a thickness corresponding approxiomately to one half the wavelength of microwave radiation for which the array is designed.

4. An antenna array according to claim 1, wherein the impedance-control means is constituted by an electrically-conductive plate of 8 mm thickness.

5. An antenna array according to claim 1, wherein the impedance-control means is constituted by an electrically-conductive plate having a thickness corresponding approximately to one quarter the wavelength of microwave radiation for which the array is designed.

* * * * *